US007350562B2

(12) United States Patent
McGuire et al.

(10) Patent No.: US 7,350,562 B2
(45) Date of Patent: Apr. 1, 2008

(54) DRILLING FLANGE AND INDEPENDENT SCREWED WELLHEAD WITH METAL-TO-METAL SEAL AND METHOD OF USE

(75) Inventors: Bob McGuire, Oklahoma City, OK (US); L. Murray Dallas, Fairview, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

(21) Appl. No.: 11/642,338

(22) Filed: Dec. 20, 2006

(65) Prior Publication Data

US 2007/0102150 A1 May 10, 2007

Related U.S. Application Data

(63) Continuation of application No. 10/656,693, filed on Sep. 4, 2003, now Pat. No. 7,159,652.

(51) Int. Cl.
*E21B 33/03* (2006.01)

(52) U.S. Cl. ..... 166/85.1; 166/85.5; 166/379

(58) Field of Classification Search ..... 166/368, 166/75.11, 85.1, 85.5, 379
See application file for complete search history.

(56) References Cited

U.S. PATENT DOCUMENTS

| | | | | |
|---|---|---|---|---|
| 2,109,031 A | | 2/1938 | O'Neal | 285/123.9 |
| 3,158,389 A | | 11/1964 | Turner | 285/123.3 |
| 3,343,603 A | | 9/1967 | Miller | 166/46 |
| 3,608,932 A | * | 9/1971 | Brown | 285/18 |
| 3,637,223 A | | 1/1972 | Weber | 277/205 |
| 3,675,719 A | | 7/1972 | Slator et al. | 166/297 |
| 4,159,135 A | | 6/1979 | Richardson | 285/336 |
| 4,281,724 A | | 8/1981 | Garrett | 175/195 |
| 4,353,420 A | | 10/1982 | Miller | 166/382 |
| 4,511,002 A | * | 4/1985 | Adamek et al. | 166/382 |
| 4,657,075 A | | 4/1987 | McLeod | 166/72 |
| 4,690,221 A | | 9/1987 | Ritter, Jr. | 166/382 |
| 4,993,488 A | | 2/1991 | McLeod | 166/72 |
| 5,092,401 A | | 3/1992 | Heynen | 166/89 |
| 5,103,900 A | | 4/1992 | McLeod et al. | 166/88.1 |
| 5,388,639 A | | 2/1995 | Betchan et al. | 166/78 |
| 5,492,373 A | | 2/1996 | Smith | 285/175 |
| 5,605,194 A | | 2/1997 | Smith | 166/382 |
| 5,660,234 A | | 8/1997 | Hebert et al. | 166/368 |
| 6,179,053 B1 | | 1/2001 | Dallas | 166/77.51 |
| 6,196,323 B1 | | 3/2001 | Moksvold | 166/368 |
| 6,199,914 B1 | | 3/2001 | Duhn | 285/123.1 |
| 6,220,363 B1 | | 4/2001 | Dallas | 166/382 |
| 6,247,537 B1 | | 6/2001 | Dallas | 166/379 |
| 6,289,993 B1 | | 9/2001 | Dallas | 166/386 |
| 6,299,216 B1 | | 10/2001 | Thompson | 285/93 |

(Continued)

*Primary Examiner*—Kenneth Thompson
(74) *Attorney, Agent, or Firm*—Nelson Mullins Riley & Scarborough, LLP

(57) ABSTRACT

A drilling flange and an independent screwed wellhead provides a metal-to-metal seal that supplements the traditional elastomeric O-rings for providing a fluid seal between the drilling flange and the wellhead. The metal-to-metal seal may be achieved using a metal ring gasket or two contacting metal surfaces that are machined to required tolerances and are configured to be forced together when the drilling flange is mounted to the wellhead. The metal-to-metal seal ensures a fluid seal between the flange body and the wellhead in the event that the O-rings malfunction or are destroyed by fire.

20 Claims, 7 Drawing Sheets

U.S. PATENT DOCUMENTS

| | | | | |
|---|---|---|---|---|
| 6,364,024 | B1 | 4/2002 | Dallas | 166/379 |
| 6,491,098 | B1 | 12/2002 | Dallas | 166/297 |
| 6,557,629 | B2 | 5/2003 | Wong et al. | 166/76.1 |
| 6,626,245 | B1 | 9/2003 | Dallas | 166/379 |
| 6,637,514 | B1 | 10/2003 | Donald et al. | 166/368 |
| 6,769,489 | B2 | 8/2004 | Dallas | 166/386 |
| 6,817,421 | B2 | 11/2004 | Dallas | 166/379 |
| 6,817,423 | B2 | 11/2004 | Dallas | 166/382 |
| 6,827,147 | B2 | 12/2004 | Dallas | 166/379 |
| 6,918,439 | B2 | 7/2005 | Dallas | 166/85.3 |
| 6,938,696 | B2 | 9/2005 | Dallas | 166/377 |
| 6,948,565 | B2 | 9/2005 | Dallas | 166/382 |
| 7,032,677 | B2 | 4/2006 | McGuire et al. | 166/379 |
| 7,040,410 | B2 | 5/2006 | McGuire et al. | 166/379 |
| 7,066,269 | B2 | 6/2006 | Dallas et al. | 166/379 |
| 7,125,055 | B2 | 10/2006 | Dallas | 285/354 |
| 2003/0141718 | A1* | 7/2003 | Bilderbeek | 285/348 |
| 2004/0090016 | A1 | 5/2004 | Sharp | 277/603 |

* cited by examiner

DRILLING FLANGE AND INDEPENDENT SCREWED WELLHEAD WITH METAL-TO-METAL SEAL AND METHOD OF USE

CROSS-REFERENCE TO RELATED APPLICATIONS

This is a continuation of U.S. patent application Ser. No. 10/656,693 filed Sep. 4, 2003 now U.S. Pat. No. 7,159,652 the entire disclosure of which is incorporated by reference herein.

MICROFICHE APPENDIX

Not Applicable.

TECHNICAL FIELD

The present invention relates generally to independent screwed wellhead assemblies and, in particular, to a drilling flange and independent screwed wellhead with a metal-to-metal seal for use in hydrocarbon well drilling.

BACKGROUND OF THE INVENTION

Independent screwed wellheads are well known in the art. The American Petroleum Institute (API) classifies a wellhead as an "independent screwed wellhead" if it possesses the features set out in API Specification 6A as described in U.S. Pat. No. 5,605,194 (Smith) entitled Independent Screwed Wellhead with High Pressure Capability and Method.

The independent screwed wellhead has independently secured heads for each tubular string supported in the well bore. The pressure within the casing is controlled by a blowout preventer (BOP) typically secured atop the wellhead. The head is said to be "independently" secured to a respective tubular string because it is not directly flanged or similarly affixed to the casing head. Independent screwed wellheads are widely used for production from low-pressure productions zones because they are economical to construct and maintain.

U.S. Pat. No. 6,199,914 (Duhn) entitled Drilling Quick Connectors discloses quick-connector fittings for rapid connection and disconnection of a drilling flange for an independent screwed wellhead. This patent is illustrative of the state of the art in drilling flanges for such wellheads.

Prior art drilling flanges for independent screwed wellheads suffer from one significant drawback. Because they are designed to contain well pressure using only elastomeric O-ring seals, they are vulnerable to fire and other environmental hazards that can cause the O-ring to malfunction. During drilling operations, sparks from the drill have been known to ignite hydrocarbons in the well, causing fires that can damage the elastomeric O-rings that provide the fluid seal between the drilling flange and the wellhead. If those O-ring seals are substantially damaged, the fluid seal is lost and oil or gas may leak from the interface between the wellhead and the drilling flange. Such leaks are undesirable and potentially dangerous.

There therefore exists a need for a drilling flange for use in an independent screwed wellhead that provides a metal-to-metal seal to ensure that a fluid seal is maintained between the wellhead and the drilling flange, even in the event of a fire on the wellhead.

SUMMARY OF THE INVENTION

It is therefore an object of the present invention to provide a drilling flange and an independent screwed wellhead that provide a metal-to-metal seal.

The present invention therefore provides an independent screwed wellhead, comprising a top end for mating engagement with a bottom end of a flange mounted thereto, the top end of the independent screwed wellhead comprising a machined socket for receiving a pin end of the bottom end of the flange, the machined socket comprising a frusto-conical surface that mates with a complementary frusto-conical surface machined on the pin end of the flange to provide a high-pressure metal-to-metal seal between the flange and the independent screwed wellhead when the pin end of the flange is received in the machined socket of the independent screwed wellhead.

The invention further provides an independent screwed wellhead, comprising a top end for mating engagement with a bottom end of a flange mounted thereto, the top end comprising a socket with a machined frusto-conical metal contact surface that mates with a complementary machined frusto-conical metal contact surface of the bottom end of the flange received in the socket when the flange is mounted to the independent screwed wellhead, the machined frusto-conical metal contact surface in the socket providing a metal-to-metal seal with the bottom end of the flange when the machined frusto-conical metal contact surface on the bottom end of the flange is forced into the socket by a lockdown nut rotatably supported by a shoulder on an outer sidewall above the bottom end of the flange, the lockdown nut engaging a thread on the top end of the independent screwed wellhead.

The invention yet further provides an independent screwed wellhead, comprising a top end for mating engagement with a bottom end of a flange mounted thereto, the top end comprising a machined socket with a frusto-conical metal contact surface that mates with a complementary frusto-conical metal contact surface machined on a pin at the bottom end of the flange, the pin end being received in the socket when the flange is mounted to the independent screwed wellhead, the frusto-conical metal contact surface in the machined socket providing a metal-to-metal seal with the pin at the bottom end of the flange when the complementary frusto-conical metal contact surface is forced into the machined socket by a lockdown nut rotatably supported by a shoulder on an outer sidewall above the bottom end of the flange, the lockdown nut engaging a thread on the top end of the independent screwed wellhead.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

In general, the invention provides an independent screwed wellhead for use in a hydrocarbon well. A metal-to-metal seal between a flange body and the independent screwed wellhead supplements elastomeric O-rings to provide a fluid seal resistant to environmental hazards. The metal-to-metal seal may be provided by a metal ring gasket seated in an annular groove in each of the independent screwed wellhead and the flange body. Alternatively, the metal-to-metal seal may be provided by contacting metal surfaces of the independent screwed wellhead and the flange body, which are machined to required tolerances. The metal-to-metal seal ensures that the fluid seal between the wellhead and the flange body remains secure in the event that the elastomeric O-rings are damaged. The drilling flange and complementary independent screwed wellhead in accordance with the invention ensures that a fluid seal is maintained at the wellhead even in the event of a fire on the wellhead.

Figure 1:
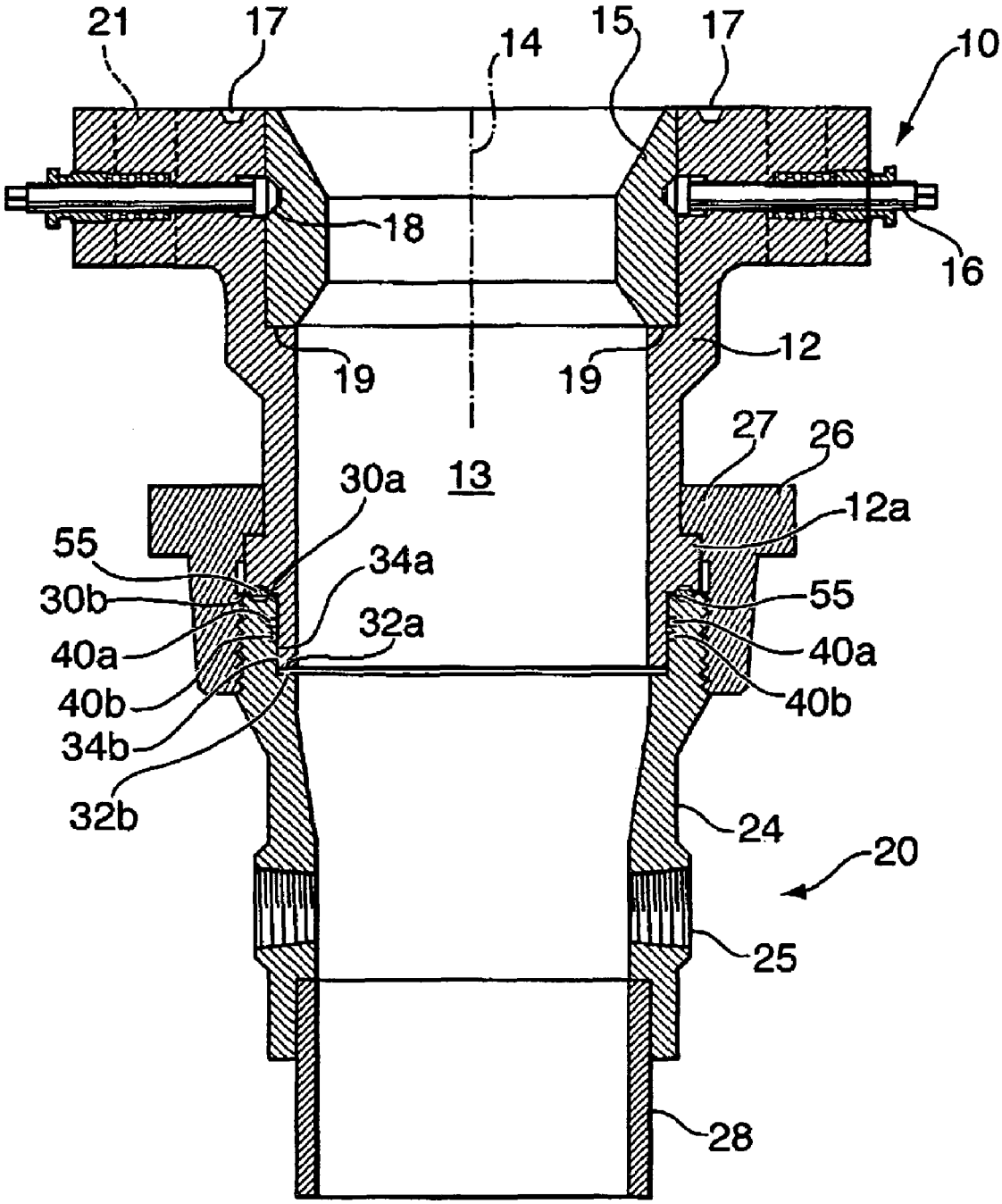
FIG. 1 is a cross-sectional view of a drilling flange mounted to an independent screwed wellhead in accordance with a first embodiment of the invention.

FIG. 1 illustrates a drilling flange 10 mounted to an independent screwed wellhead 20 in accordance with a first embodiment of the invention. The drilling flange 10 includes a generally annular flange body 12 and an axial passageway 13 through the annular flange body 12 which is aligned with a drilling axis 14. The axial passageway 13 has a diameter that is at least as large as the diameter of a passageway through the wellhead 20.

The drilling flange 10 supports a wear bushing 15, which is preferably constructed of hardened steel to withstand the wear caused by a rotating drill string (not shown). The wear bushing 15 rests on an annular shoulder 19 and is locked in place by a plurality of radial locking pins 16 having beveled heads that engage a peripheral groove 18 in an outer surface of the wear bushing 15. The locking pins 16 are received in threaded radial bores through a top end of the annular flange body 12. The locking pins 16 can be backed-off to permit the wear bushing 15 to be removed for servicing or replacement. The drilling flange 10 also includes a flange gasket groove 17 on the top surface of the drilling flange 10, and through bores 21 that permit attachment of a blowout preventer (BOP) or other pressure containment spool (not shown).

The wellhead 20 includes an annular wellhead body 24. The wellhead body 24 is secured to a surface casing 28 that surrounds an outer periphery of the well bore at ground level. The wellhead body 24 includes threaded ports 25 for supporting plugs or valves, in a manner well known in the art.

A lockdown nut 26 secures the drilling flange 10 to the wellhead 20. The lockdown nut 26 may be a hammer union, for example. The lockdown nut 26 ensures that the drilling flange 10 is tightly secured to the wellhead 20 while permitting the drilling flange to be rapidly mounted to, or removed from, the wellhead 20. As shown in FIG. 1, an outer sidewall at a bottom end of the drilling flange 10, includes an annular shoulder 12*a* that rotatably supports an annular portion 27 of the lockdown nut 26.

The drilling flange 10 has an upper abutment surface 30*a*, a lower abutment surface 32*a* and a lateral contact surface 34*a*. The wellhead 20 also has a corresponding upper abutment surface 30*b*, a corresponding lower abutment surface 32*b* and a corresponding lateral contact surface 34*b* which mate with the respective surfaces of the drilling flange as shown in FIG. 1. The lateral contact surfaces 34*a*, 34*b* are cylindrical in this embodiment.

Two elastomeric O-rings 40*a,b* are received in radial grooves at the interface of the lateral contact surfaces 34*a*, 34*b*. The radial grooves are received in grooves in the lateral contact surface 34*b*. These O-rings 40*a,b* provide a fluid seal between the drilling flange 10 and the wellhead 20. A person skilled in the art will readily appreciate that the number and precise position of the O-rings may be varied.

In addition to the elastomeric O-rings 40*a,b*, a fluid seal is also provided between the drilling flange 10 and the wellhead 20 by a metal ring gasket 55 that provides a metal-to-metal seal. The metal ring gasket 55 is preferably made of a type of steel that retains its mechanical properties at high temperatures. If a fire erupts in or around the well, the elastomeric O-rings 40*a,b* are susceptible to damage. The metal-to-metal seal is designed to provide a fluid-tight seal, even after the elastomeric O-rings 40*a,b* have been damaged or destroyed. Thus, the drilling flange 10 is designed to maintain the fluid-tight seal with the wellhead 20 even after exposure to the high temperatures associated with well fires.

It should be noted that the embodiments of the invention are operable without any elastomeric O-rings. A metal-to-metal seal is sufficient although persons skilled in the art will appreciate that the primary utility of the metal-to-metal seal is as a backup for the O-ring seals in the event of fire.

Figure 2:
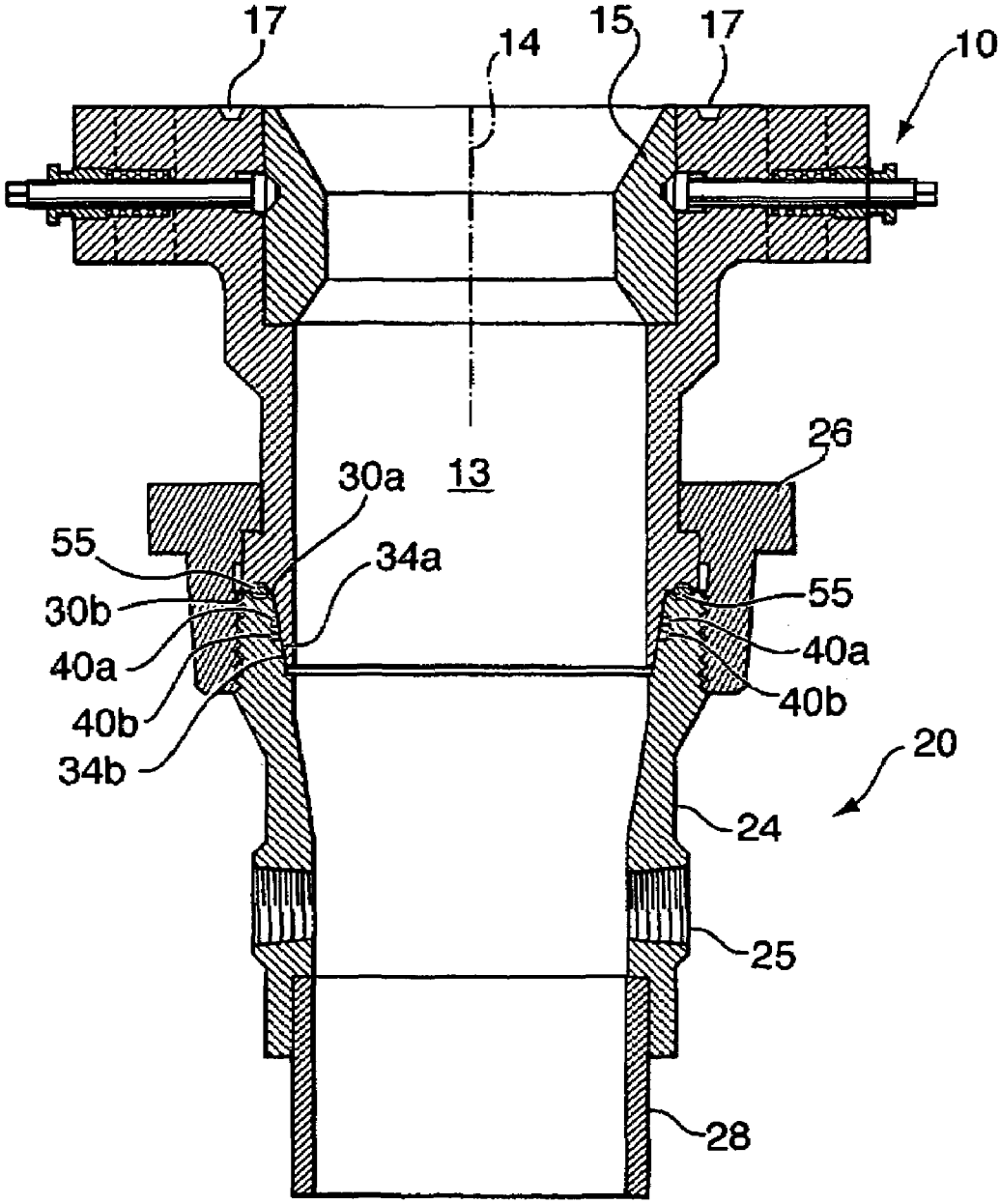
FIG. 2 is a cross-sectional view of a drilling flange mounted to an independent screwed wellhead in accordance with a second embodiment of the invention.

FIG. 2 is a cross-sectional view of a second embodiment of a drilling flange and the independent screwed wellhead 20. The lateral contact surfaces 34*a*, 34*b* of the drilling flange 10 are frusto-conical. The frusto-conical axial contact surfaces 34*a*, 34*b* converge in the downward, drilling direction. Two O-rings 40*a,b* are seated along the frusto-conical surface 34*b* in radial grooves cut into the wellhead. A metal ring gasket 55 is seated in a groove in the upper abutment surface 30*b*.

Figure 3:
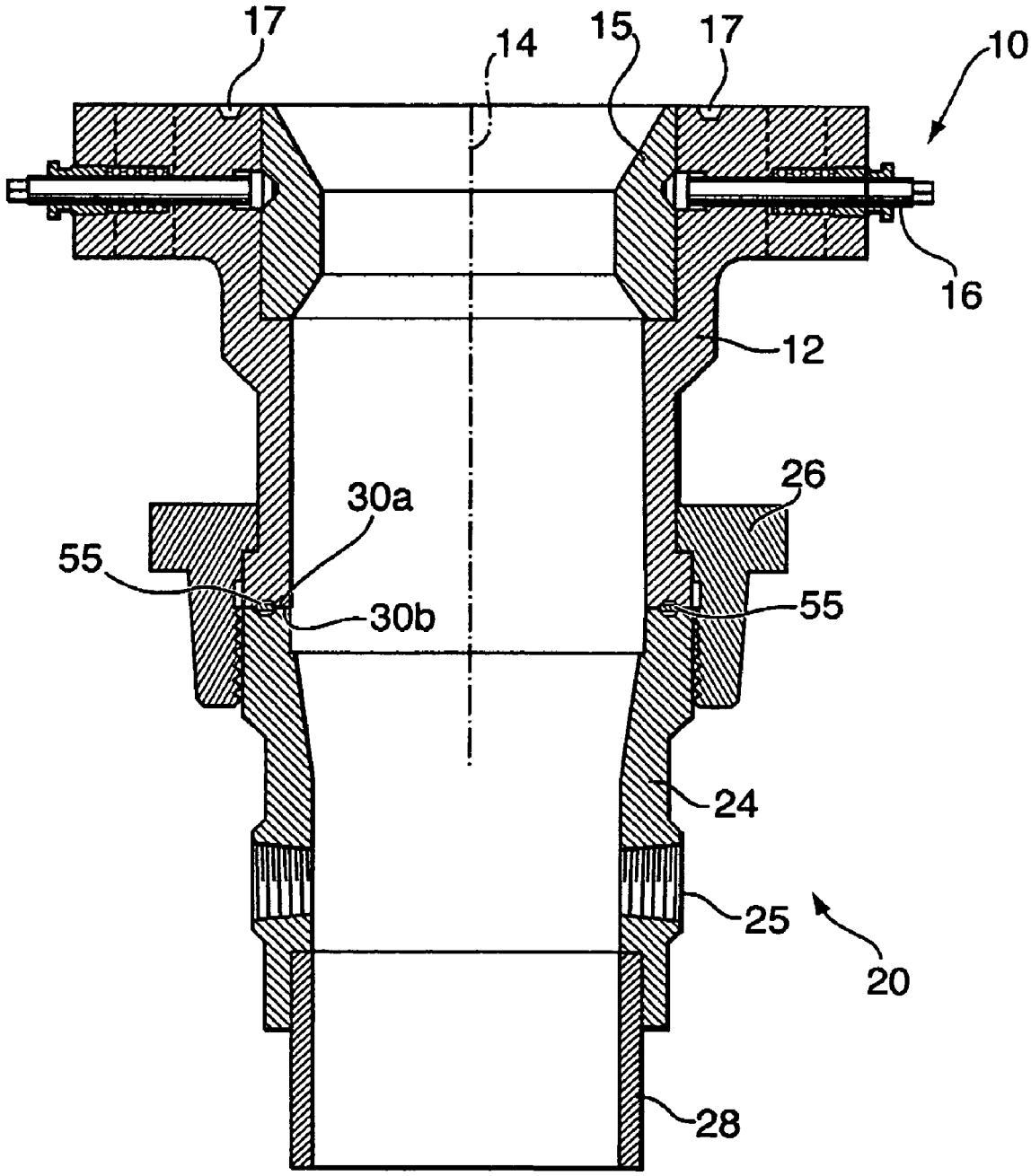
FIG. 3 is a cross-sectional view of a drilling flange mounted to an independent screwed wellhead in accordance with a third embodiment of the invention.

FIG. 3 depicts a third embodiment of the drilling flange 10 and the independent screwed wellhead 20. In this embodiment, a metal ring gasket 55 is seated in a groove located at the interface of the upper abutment surfaces 30*a*, 30*b*. The groove is cut into both the upper abutment surface 30*a* of the drilling flange 10 and the upper abutment surface 30*b* of the wellhead 20. An upper half of the metal ring gasket is received in the groove formed in the upper abutment surface 30*a* and a lower half of the ring gasket is received in the groove formed in the upper abutment surface 30*b*.

Figure 4:
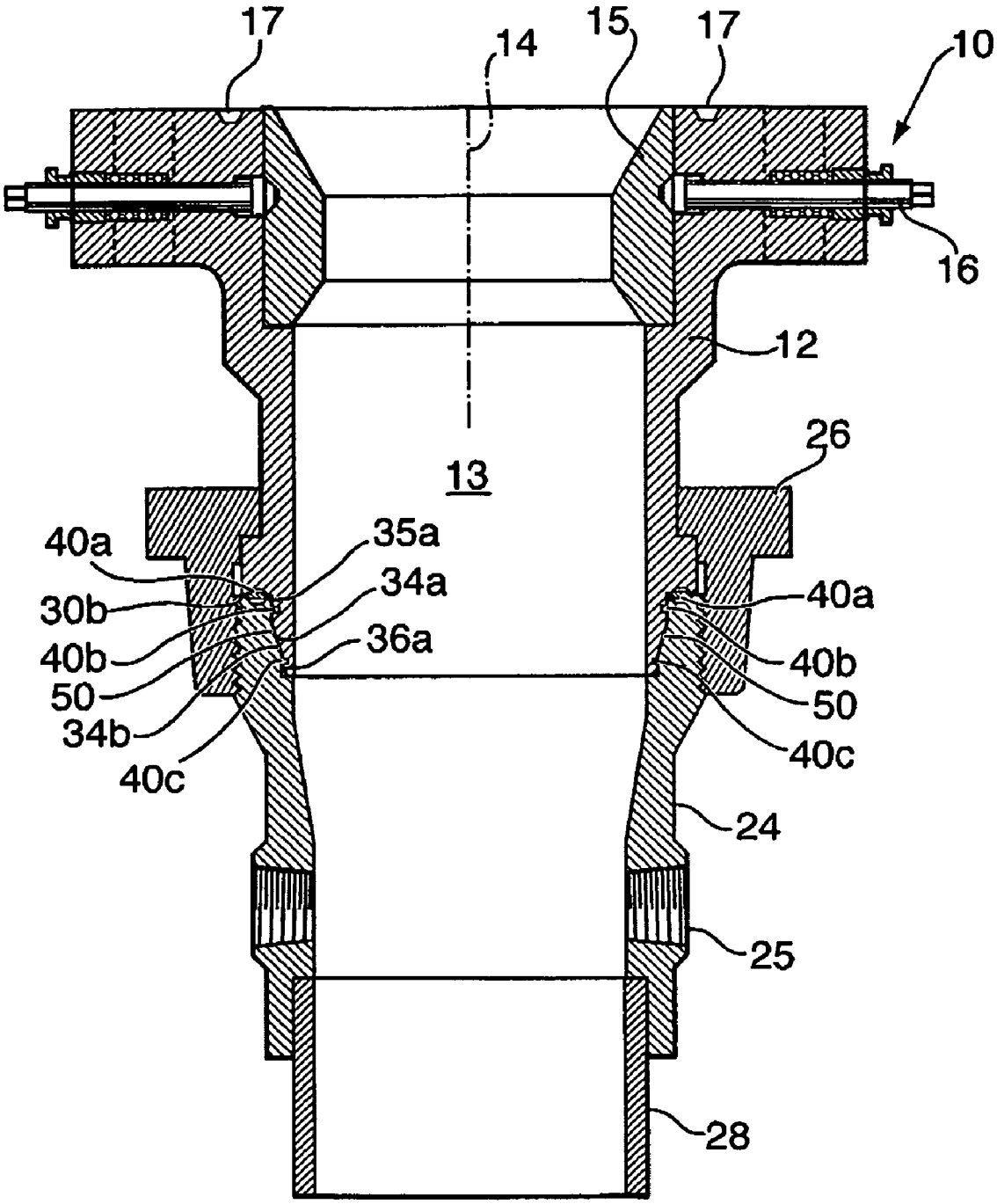
FIG. 4 is a cross-sectional view of a drilling flange mounted to an independent screwed wellhead in accordance with a fourth embodiment of the invention.

FIG. 4 shows a fourth embodiment of the invention. In this fourth embodiment, there are three O-rings 40*a-c*, as well as a metal-to-metal surface seal 50, which provide the fluid seal between the drilling flange 10 and the wellhead 20. O-ring 40*a* is located in a groove in the upper abutment surface 30*b* of the wellhead 20. The second O-ring 40*b* is located in a radial groove in an upper cylindrical surface 35*a* of the drilling flange 10. The third O-ring 40*c* is located in a radial groove in a lower cylindrical surface 36*a* of the drilling flange 10. The metal-to-metal surface seal 50 is located along the frusto-conical contact surfaces 34*a*, 34*b*. The metal-to-metal seal 50 is achieved when the two smooth, flat, parallel contact surfaces 34*a*, 34*b*, which are machined to a required tolerance, are forced together by a downward force exerted by the lockdown nut 26.

Figure 5:
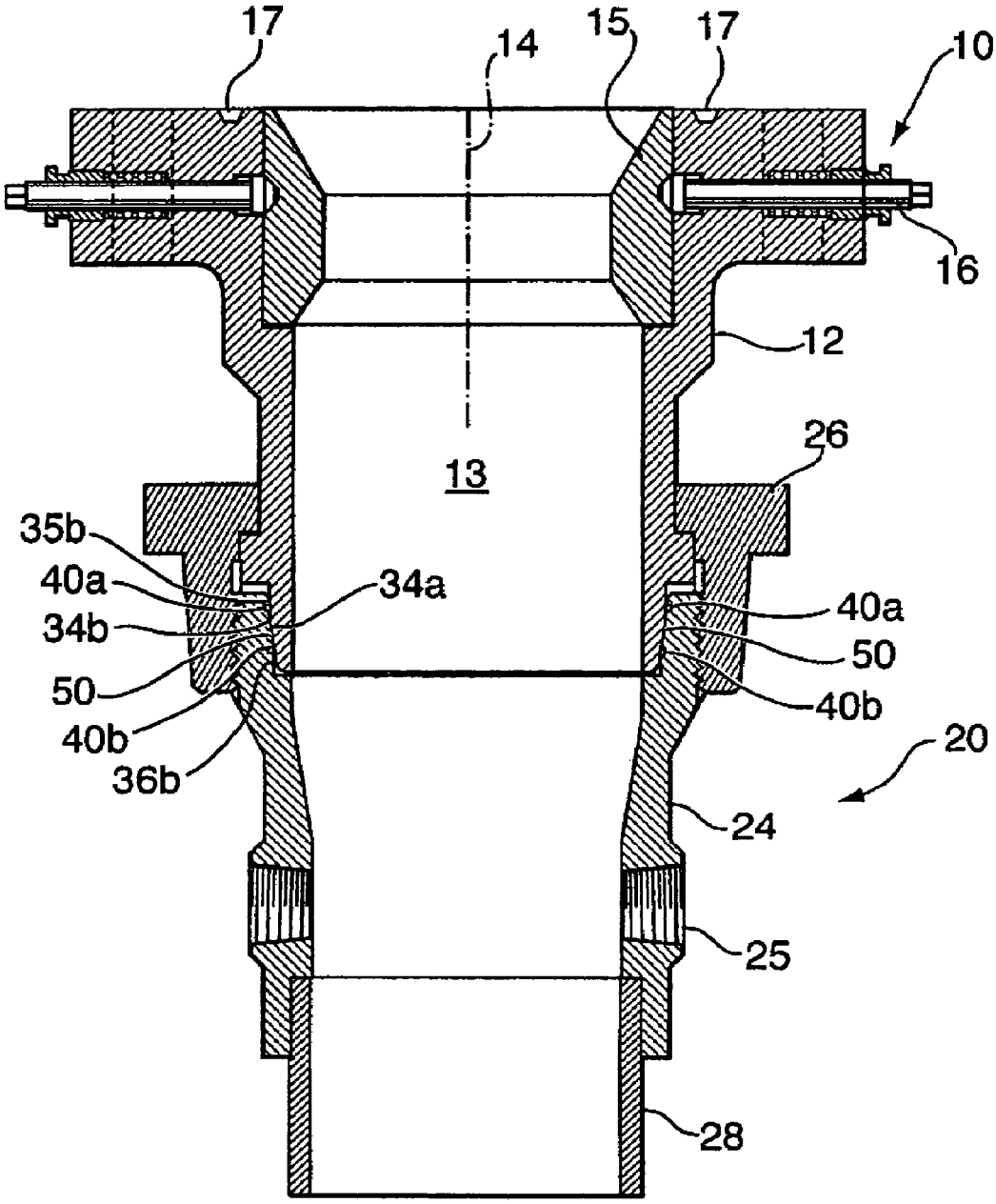
FIG. 5 is a cross-sectional view of a drilling flange mounted to an independent screwed wellhead in accordance with a fifth embodiment of the invention.

FIG. 5 shows a fifth embodiment of the invention. In this fifth embodiment, two O-rings 40*a,b* and a metal-to-metal surface seal 50 provide a fluid seal between the drilling flange 10 and the wellhead 20. A first O-ring 40*a* is located in a radial groove in an upper cylindrical surface 35*b* of the wellhead 20. The second O-ring 40*b* is located in a radial groove in a lower cylindrical surface 36*b* of the wellhead 20. The metal-to-metal surface seal 50 is achieved when the frusto-conical axial contact surfaces 34*a*, 34*b* which are machined at about 4°-10° from the vertical at required tolerances, are forced together by downward pressure exerted by the lockdown nut 26. In this embodiment, the contact surfaces are respectively machined at 7° from vertical.

Figure 6:
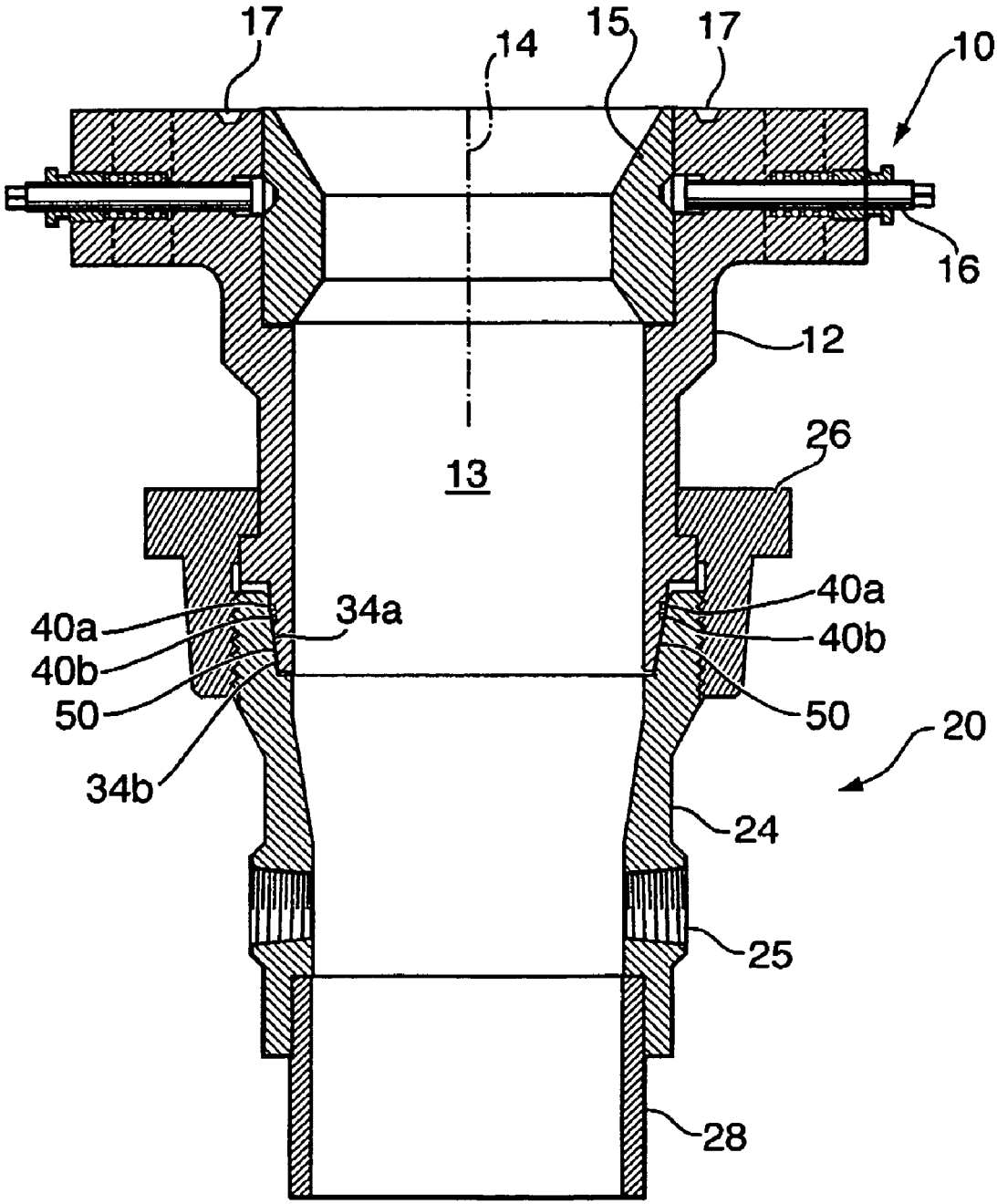
FIG. 6 is a cross-sectional view of a drilling flange mounted to an independent screwed wellhead in accordance with a sixth embodiment of the invention.

FIG. 6 illustrates a sixth embodiment of the invention. In this sixth embodiment, the fluid seal between the drilling flange 10 and the wellhead 20 is provided by two O-rings 40*a,b* and a metal-to-metal surface seal 50. The two O-rings 40*a,b* are seated in respective grooves in the frusto-conical axial contact surface 34*a*. The metal-to-metal surface seal 50 is achieved below the O-rings when the frusto-conical axial contact surfaces 34*a*, 34*b*, which are machined to required tolerances, are forced into contact by pressure exerted by the lockdown nut 26.

Figure 7:
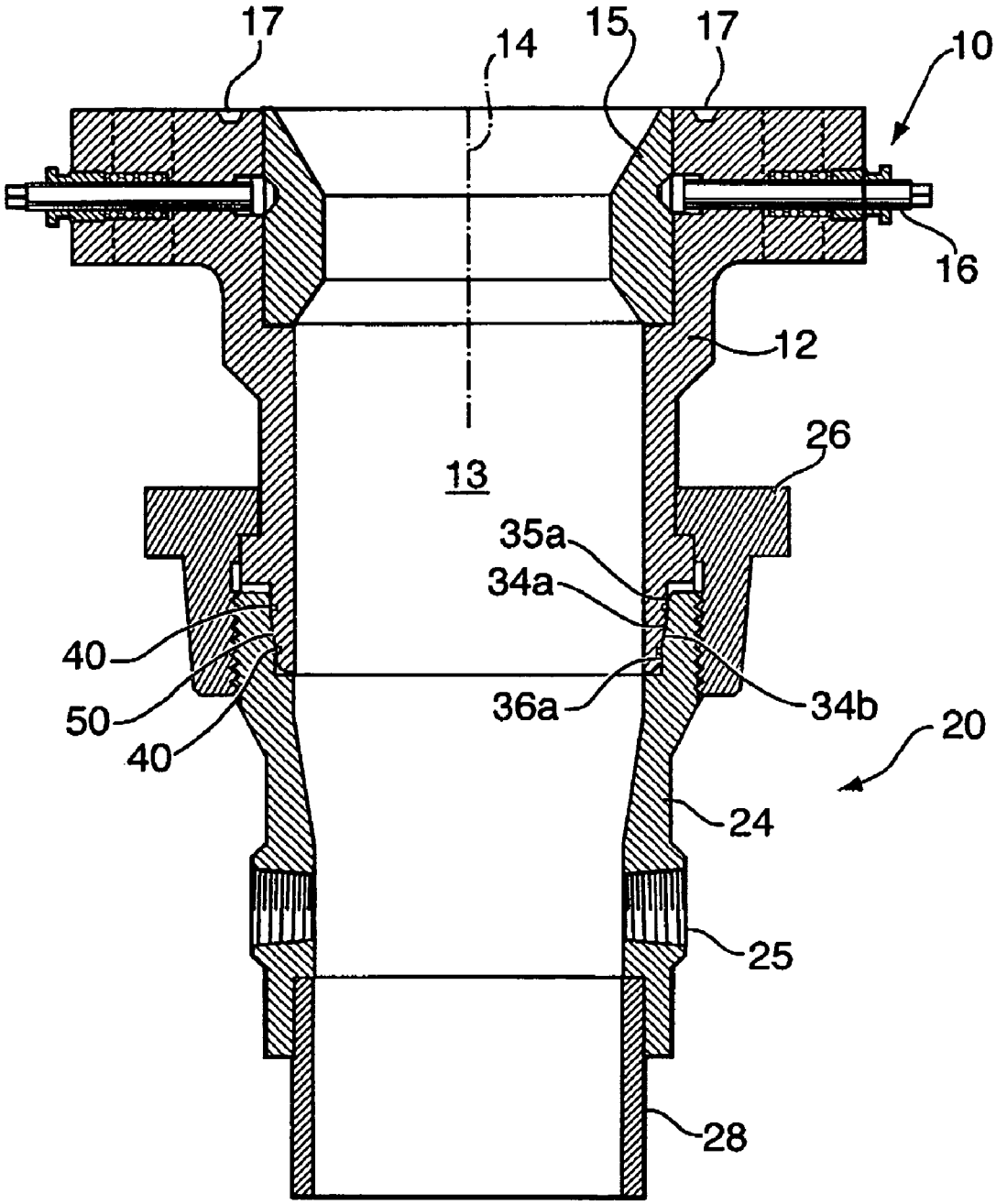
FIG. 7 is a cross-sectional view of a drilling flange mounted to an independent screwed wellhead in accordance with a seventh embodiment of the invention.

FIG. 7 shows a seventh embodiment of the invention. In this seventh embodiment, two O-rings 40*a,b* and a metal-to-metal surface seal 50 provide the fluid seal between the drilling flange 10 and the wellhead 20. The first O-ring 40*a* is seated in a radial groove located in an upper cylindrical surface 35*a* of the drilling flange 10. The second O-ring 40*b* is seated in a radial groove located in a lower cylindrical surface 36*a* of the drilling flange. The metal-to-metal surface seal 50 is formed when the frusto-conical contact surfaces 34*a*, 34*b*, which, as described above, are machined to required tolerances, are forced together by pressure exerted when the lockdown nut 26 when it is tightened to achieve the fluid seal.

The drilling flange 10 and the independent screwed wellhead are used to drill a wellbore that communicates with one or more subterranean production zones using a drilling rig, in a manner that is well known in the art. In use, a drill string of the drilling rig (not shown) is inserted through the wear bushing 15, along the drilling axis 14. The drill string is rotated to drive a drill bit connected to a bottom end of the drill string. The drill bit bores through the earth to form the wellbore. As the drill bit advances, joints are added to the drill string as required. The metal-to-metal seal between the drilling flange 10 and the independent screwed wellhead ensures that a fluid seal is maintained between them at all times, even in the event of a fire at the wellhead.

As will be appreciated by persons skilled in the art, the drilling flange 10 can be rapidly mounted to an independent screwed wellhead 20, or removed from the wellhead 20. Since the wear bushing 15 is replaceable, the drilling flange 10 has a long service life and is therefore economical to use. Furthermore, because the drilling flange 10 provides a reliable metal-to-metal fluid seal, the drilling flange 10 can be safely used even for applications where there is danger of a fire or other environmental hazard at the wellhead that could potentially cause the O-rings to malfunction.

The embodiments of the invention described above are therefore intended to be exemplary only. The scope of the invention is intended to be limited solely by the scope of the appended claims.

We claim:

1. An independent screwed wellhead, comprising a top end for mating engagement with a bottom end of a flange mounted thereto, the top end of the independent screwed wellhead comprising a machined socket for receiving a pin end of the bottom end of the flange, the machined socket comprising a frusto-conical surface offset from an axial plane of the independent screwed wellhead by 4°-10° that mates with a complementary frusto-conical surface machined on the pin end of the flange to provide a high-pressure metal-to-metal seal between the flange and the independent screwed wellhead when the pin end of the flange is received in the machined socket of the independent screwed wellhead.

2. The independent screwed wellhead as claimed in claim 1 wherein the frusto-conical surface is offset from an axial plane of the independent screwed wellhead by 7°.

3. The independent screwed wellhead as claimed in claim 1 further comprising a radial groove in a sidewall of the machined socket in the top end of the independent screwed wellhead for receiving an elastomeric seal ring for providing another high-pressure seal between the independent screwed wellhead and the flange.

4. The independent screwed wellhead as claimed in claim 1 further comprising first and second radial grooves in a sidewall of the machined socket in the top end of the independent screwed wellhead for respectively receiving an elastomeric seal ring for providing first and second high-pressure seals between the independent screwed wellhead and the flange.

5. The independent screwed wellhead as claimed in claim 4 wherein the first and second radial grooves are respectively located above the frusto-conical surface.

6. The independent screwed wellhead as claimed in claim 4 wherein the first radial groove is located above the frusto-conical surface and the second radial groove is located below the frusto-conical surface.

7. An independent screwed wellhead, comprising a top end for mating engagement with a bottom end of a flange mounted thereto, the top end comprising a socket with a machined frusto-conical metal contact surface that mates with a complementary machined frusto-conical metal contact surface of the bottom end of the flange received in the socket when the flange is mounted to the independent screwed wellhead, the machined frusto-conical metal contact surface in the socket providing a metal-to-metal seal with the bottom end of the flange when the machined frusto-conical metal contact surface on the bottom end of the flange is forced into the socket by a lockdown nut rotatably supported by a shoulder on an outer sidewall above the bottom end of the flange, the lockdown nut engaging a thread on the top end of the independent screwed wellhead.

8. The independent screwed wellhead as claimed in claim 7 wherein the machined frusto-conical metal contact surface is offset from an axial plane of the independent screwed wellhead by 4°-10°.

9. The independent screwed wellhead as claimed in claim 8 wherein the machined frusto-conical metal contact surface is offset from the axial plane of the independent screwed wellhead by 7°.

10. The independent screwed wellhead as claimed in claim 7 further comprising a radial groove in a sidewall of the socket in the top end for receiving an elastomeric seal ring for providing another high-pressure seal between the independent screwed wellhead and the flange.

11. The independent screwed wellhead as claimed in claim 7 further comprising a pair of radial grooves in a sidewall of the socket for respectively receiving an elastomeric seal ring for providing additional high-pressure seals between the independent screwed wellhead and the flange.

12. The independent screwed wellhead as claimed in claim 11 wherein the pair of radial grooves are located above the machined frusto-conical metal contact surface.

13. The independent screwed wellhead as claimed in claim 11 wherein a first of the pair of radial grooves is located above the machined frusto-conical metal contact surface and a second of the pair of radial grooves is located below the machined frusto-conical metal contact surface.

14. An independent screwed wellhead, comprising a top end for mating engagement with a bottom end of a flange mounted thereto, the top end comprising a machined socket with a frusto-conical metal contact surface that mates with a complementary frusto-conical metal contact surface machined on a pin at the bottom end of the flange, the pin end being received in the machined socket when the flange is mounted to the independent screwed wellhead, the frusto-conical metal contact surface in the machined socket providing a metal-to-metal seal with the pin at the bottom end of the flange when the complementary frusto-conical metal contact surface is forced into the machined socket by a lockdown nut rotatably supported by a shoulder on an outer sidewall above the bottom end of the flange, the lockdown nut engaging a thread on the top end of the independent screwed wellhead.

15. The independent screwed wellhead as claimed in claim 14 wherein the frusto-conical metal contact surface is offset from an axial plane of the independent screwed wellhead by 4°-10°.

16. The independent screwed wellhead as claimed in claim 15 wherein the frusto-conical metal contact surface is offset from the axial plane of the independent screwed wellhead by 7°.

17. The independent screwed wellhead as claimed in claim 14 further comprising a radial groove in an inner sidewall of the machined socket for receiving an elastomeric seal ring for providing another high-pressure seal between the independent screwed wellhead and the flange.

18. The independent screwed wellhead as claimed in claim 14 further comprising first and second radial grooves in an inner sidewall of the machined socket for respectively receiving an elastomeric seal ring for providing additional high-pressure seals between the independent screwed wellhead and the flange.

19. The independent screwed wellhead as claimed in claim 18 wherein the elastomeric seal rings comprise O-rings.

20. The independent screwed wellhead as claimed in claim 18 wherein the first radial groove is located in an upper cylindrical surface of the machined socket above the frusto-conical metal contact surface, and the second radial groove is located in a lower cylindrical surface of the machined socket below the frusto-conical metal contact surface.

* * * * *